United States Patent [19]

Shou-Fu

[11] Patent Number: 4,745,842

[45] Date of Patent: May 24, 1988

[54] SPIRAL DRUM MAGAZINE WITH ELONGATED MAGAZINE CLIP AND MULTIPLE LINK LAST ROUND FOLLOWER

[75] Inventor: Zhong Shou-Fu, Shandong, China

[73] Assignee: Poly Technologies, Inc., Beijing, China

[21] Appl. No.: 920,046

[22] Filed: Oct. 16, 1986

[51] Int. Cl.[4] ..... F41D 10/42

[52] U.S. Cl. ..... 89/33.02; 42/49.01

[58] Field of Search ..... 42/49.01; 89/33.02

[56] References Cited

U.S. PATENT DOCUMENTS

| | | | |
|---|---|---|---|
| 111,827 | 2/1871 | Elliot | 89/33.02 |
| 1,347,755 | 7/1920 | Payne . | |
| 1,353,092 | 9/1920 | Thompson et al. . | |
| 1,361,402 | 12/1920 | Payne | 89/33.02 |
| 2,064,888 | 12/1936 | Dickinson | 42/6 |
| 2,066,361 | 1/1937 | Nomar | 42/6 |
| 2,114,311 | 4/1938 | Nomar | 42/49.01 |
| 2,130,722 | 9/1938 | Kobe | 42/19 |
| 2,131,412 | 9/1938 | Ostman | 42/49.01 |
| 2,161,696 | 6/1939 | Blacher | 42/49.01 |
| 2,321,720 | 6/1943 | Whittaker | 89/33.02 |
| 2,338,984 | 1/1944 | Van Horn et al. | 42/50 |
| 2,394,606 | 2/1946 | Gazdd | 89/33.02 |
| 2,407,461 | 9/1946 | Vesely | 89/33.02 |
| 4,034,644 | 7/1977 | Hupp et al. | 89/33.17 |
| 4,384,508 | 5/1983 | Sullivan et al. | 89/33.02 |
| 4,487,103 | 12/1984 | Atchisson | 89/33.02 |

FOREIGN PATENT DOCUMENTS

| | | | |
|---|---|---|---|
| 237418 | 8/1945 | Switzerland | 89/33.02 |

OTHER PUBLICATIONS

*The World's Submachine Guns,* vol. I, Thomas B. Nelson, 19 pages.

*Primary Examiner*—Stephen C. Bentley
*Attorney, Agent, or Firm*—Thomas & Kennedy

[57] ABSTRACT

The magazine includes a clip magazine (22) above a drum magazine (11) and connectable to an automatic weapon. Door (15) is hinged at its lower edge to open downwardly from clip magazine (22). The torsion spring (21) can be wound by external crank (20), and the spring bias can be relieved by pushing latch plunger (60). The protrusion (102, 103) of the last round follower (85) moves progressively along the spiral path (81) of the drum magazine (11) and its three links (86, 88 and 89) move through the turn and into the clip magazine (22) to push the last round of ammunition to the weapon.

19 Claims, 4 Drawing Sheets

SPIRAL DRUM MAGAZINE WITH ELONGATED MAGAZINE CLIP AND MULTIPLE LINK LAST ROUND FOLLOWER

FIELD OF THE INVENTION

This invention relates to a magazine into which rounds of ammunition can be loaded, and which can be connected to an automatic rifle. More particularly, the invention relates to a drum magazine having a drum with spiral path therein which is followed by the rounds of ammunition, a rotor for moving the ammunition in series along the spiral path to the drum outlet opening, a clip magazine connected to the outlet of the drum, and a last round follower which urges the last round of ammunition out of the opening of the spiral drum and on through the clip magazine toward the weapon.

BACKGROUND OF THE INVENTION

In the use of automatic fire arms where a plurality of rounds of ammunition are to be fed in a short period to the chamber of the weapon, it has been common to use elongated clips which store the rounds of ammunition, and a spring is used to bias the rounds of ammunition toward the chamber of the weapon. Where it is desirable to have a larger number of rounds of ammunition available than can be accommodated by a conventional clip magazine, drum magazines have been utilized which store the rounds of ammunition in a circular arrangement beneath the weapon, and the rounds are fed in series along a circular path toward the breech of the weapon. Further, drum magazines having spiral paths for the rounds have been used whereby the rounds are stored in a concentric circular arrangement within a drum and follow a spiral path so as to be fed in series to the weapon. In both the plain drum and spiral drum magazines a last round follower is utilized for pushing the last round of ammunition out of the drum and on into the chamber of the weapon.

While drum magazines have been utilized to hold large numbers of rounds of ammunition, some of the weapons cannot accommodate a drum magazine because of the shape of the weapon. For example, weapons having trigger guards or stock components adjacent the breech of the weapon sometimes do not provide enough room for attachment of the drum magazine. Thus, it would be desirable to utilize a drum magazine in combination with a conventional elongated clip magazine, whereby the clip magazine is attached to the weapon and the drum magazine is attached to the clip magazine, with the drum magazine feeding rounds of ammunition to the clip magazine and with the clip magazine transferring the rounds of ammunition on to the weapon. This arrangement would support the drum magazine in spaced relationship from the weapon so that the components of the weapon would not interfere with the mounting of the drum magazine to the weapon, and the weapon, and enable the combination drum and clip magazines to accommodate more rounds of ammunition. However, a satisfactory last round followers has not been developed in the prior art which is capable of not only urging the last round from the drum magazine out of its opening but also entirely through the elongated clip magazine to the weapon.

SUMMARY OF THE INVENTION

Briefly described, the present invention comprises a storage magazine for rounds of ammunition to be fed to an automatic weapon which includes a drum magazine having a spiral path formed therein for placement of rounds of ammunition, and an elongated clip magazine mounted to the outlet opening of the drum magazine, a rotor within the drum magazine for moving the rounds of ammunition along the spiral path, and a last round follower which is formed in multiple links that not only moves the last round of ammunition out of the drum magazine but also urges the last round of ammunition along the length of the clip magazine on into the breech of the weapon.

The spiral drum magazine includes a rotor that has a pair of parallel, concentric rotor plates maintained in parallel relationship by intermediate connecting pins. In the disclosed embodiment of the invention the last round follower is positioned generally between the rotor plates and is formed in three links, with the first link pivotably connected at one of its ends to an outer peripheral portion of the rotor plates, an intermediate link connected to the first link, and an outer link connected at one of its ends to the intermediate link, with the outer link including at its distal end a protrusion which is of a size and shape approximately the same as a single round of ammunition, and which extends into the spiral path of the drum and which pushes the last round of ammunition from the drum into the elongated clip magazine.

The multiple link last round follower is arranged so that its protrusion which engages the last round of ammunition can change directions of movement from its spiral path in the drum to a radial direction so it can move on through the clip magazine, thus pushing the last round of ammunition through the clip magazine to the weapon.

Thus, it is an object of this invention to provide an improved drum magazine for providing large numbers of rounds of ammunition to a weapon, which has the capability of moving the rounds of ammunition through an intermediate elongated clip magazine that extends between the drum magazine and the weapon.

Another object of this invention is to provide a reliable magazine for accommodating large numbers of rounds of ammunition, and which is light weight and has the ability to rapidly feed the ammunition to its weapon.

Another object of this invention is to provide a spiral drum magazine for a weapon which includes an elongated clip magazine that attaches directly to the weapon, with a drum magazine attached to the distal end of the clip magazine, and with a last round follower than functions to move the last round of ammunition from the drum magazine longitudinally through the clip magazine into the chamber of the weapon.

Another object of this invention is to provide a combination of a spiral drum magazine and an elongated clip magazine for attachment to a weapon, which holds a large number of rounds of ammunition and which reliably feeds the rounds of ammunition first in a spiral path within the drum magazine and then along a longitudinal path extending between the drum magazine to the weapon.

Other objects, features and advantages of this invention will become apparent upon reading the following specification, when taken in conjunction with the accompanying drawings.

DETAILED DESCRIPTION

Figure 1:
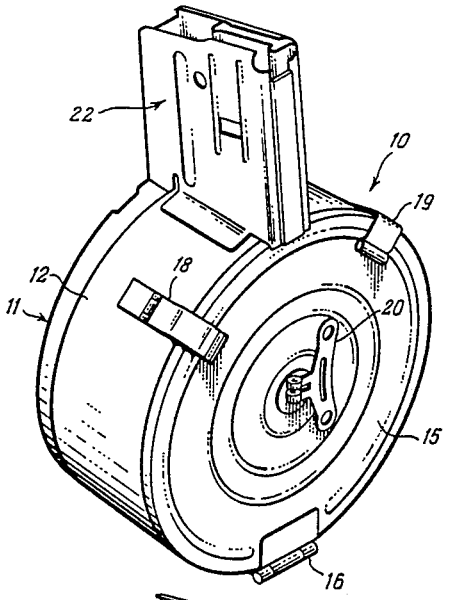
FIG. 1 is a perspective illustration of the spiral drum magazine.
Figure 2:
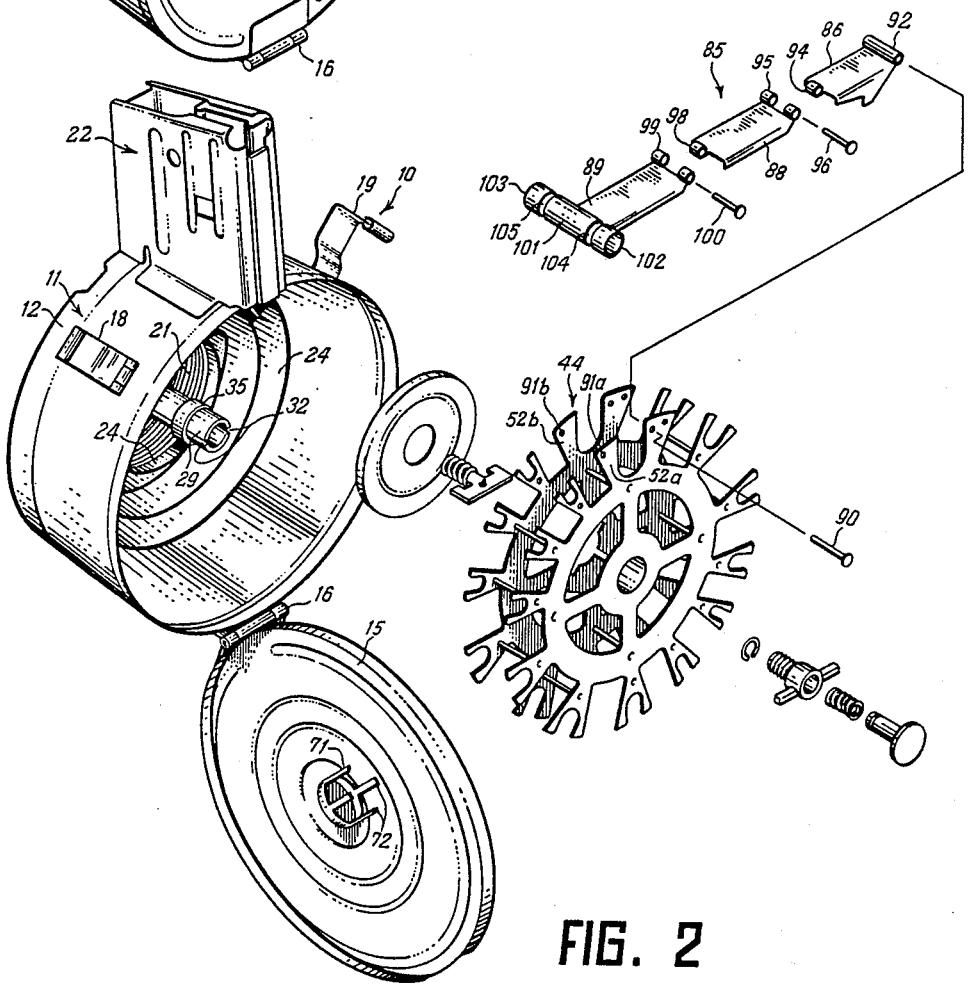
FIG. 2 is an exploded perspective view of the spiral drum magazine, showing the internal components.

Referring now in more detail to the drawings, in which like numerals indicate like parts throughout the several views, FIG. 1 illustrates the spiral drum magazine 10 which includes a drum 11 having a cylindrical outer wall 12, front wall 14 (FIG. 2), and door 15 which functions as a rear wall. Door 15 is attached to drum 11 by hinge 16 at the bottom of the door and the drum, and L-shaped latches 18 and 19 are mounted to the outer upper surface of drum 11 and pivot over door 15 into frictional engagement therewith so as to hold the door 15 in its closed position. A crank 20 is pivotably mounted to door 15 at its center portion, so as to enable the user of the magazine to wind the torsion spring 21 (FIG. 2). An elongated clip magazine 22 is mounted to the upper portion of drum 11. Clip magazine 22 is to be connected to the lower breech opening of the weapon (not shown).

Figure 3:
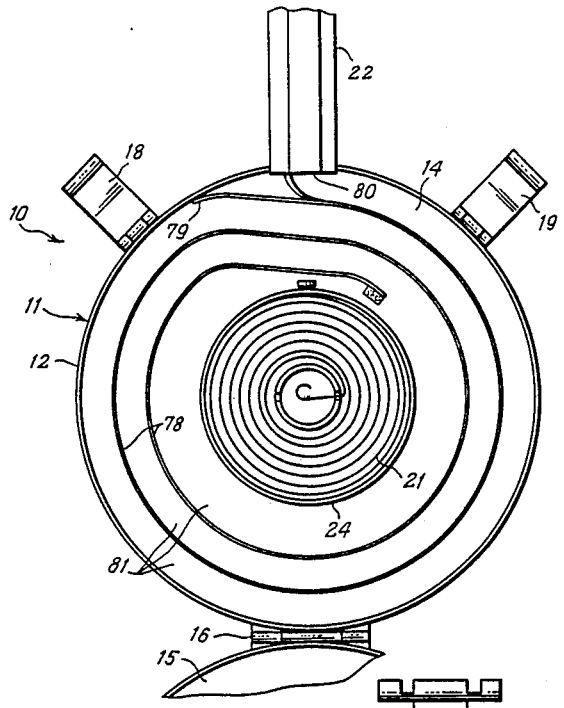
FIG. 3 is an end view of the internal components of the drum of the magazine.
Figure 4:
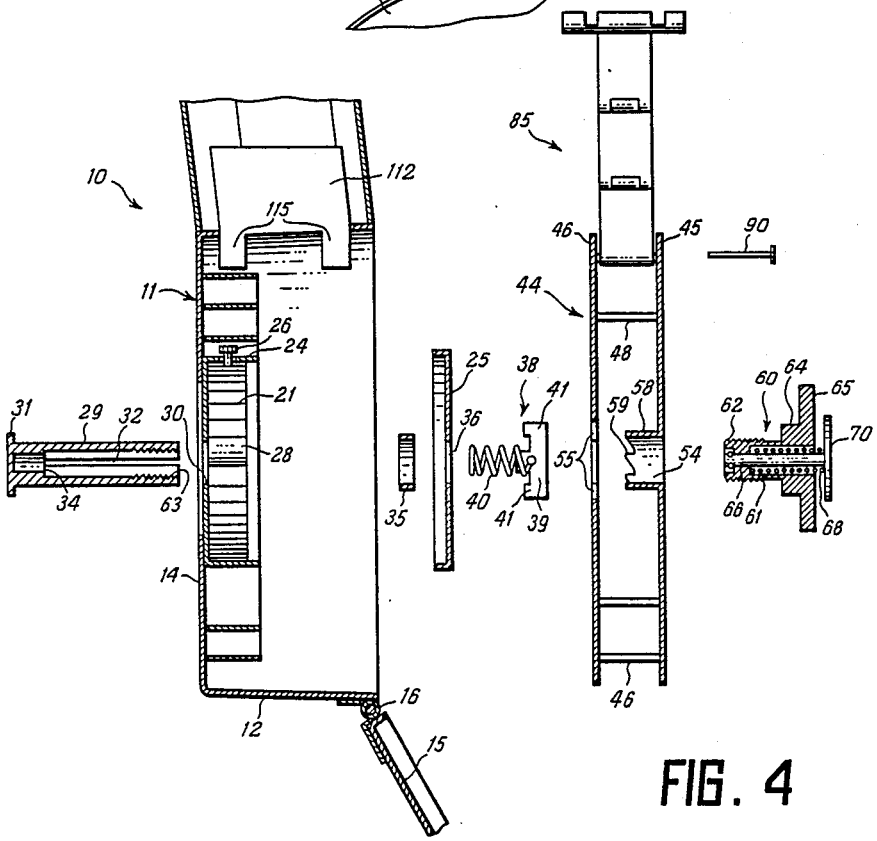
FIG. 4 is an exploded side cross-sectional view of the spiral drum magazine.

As illustrated in FIGS. 2 and 3, drum 11 includes an inner cylindrical housing 24 which accommodates torsion spring 21, with the housing 24 being concentric with drum 11. Cap 25 is sized and shaped to fit about and to close inner cylindrical housing 24. The outer portion of spiral torsion spring 21 is fastened to inner cylindrical housing 24 by screw 26, and the inner end 28 of the torsion spring 21 is formed at a right angle. Spring axle 29 extends through the front aperture 30 of drum 11, with the front aperture 30 being concentric with respect to the drum. Spring axle 29 includes an end cap 31 at one end, and the spring axle is tubular with longitudinal slots 32 formed therein, and with an internal shoulder 34 adjacent cap 31. When spring axle 29 is inserted through front aperture 30, the right angle end portion 28 of the torsion spring 21 is received in one of the slots 32. Washer 35 is positioned over the inwardly protruding end of spring axle 29, and the central opening 36 of cap 25 is positioned about the inwardly protruding portion of spring axle 29.

Spring latch assembly 38 comprises latch 39 and coil compression spring 40 attached to the latch. Coil compression spring 40 is sized and shaped so as to be telescopically received in the longitudinal opening of spring axle 29, and the latch is also slid into the slots 32, with the wings 41 of the latch protruding out through the slot 32.

Rotor 44 is approximately disk shaped and is of a diameter slightly smaller than the inside diameter of drum 11. Rotor 44 comprises a pair of spaced rotor plates 45 and 46 which are maintained in aligned, parallel relationship by a plurality of spacer pins 48.

The rotor plates 45 and 46 of rotor 44 are substantially identical and are parallel, coaxial, and circumferentially aligned. Each rotor 45 and 46 includes a central hub 49, radially extending arms 50 extending at 90° intervals from hub 49, intermediate ring 51 and a plurality of dividers 52 which extend radially outwardly from intermediate ring 51. A central opening 54 is formed in each hub 49 of each rotor plate 45 and 46, so that the hubs can be telescopically mounted about spring axle 29. Positioning slots 55 are formed at 90° intervals about the inner edge of central opening 54 of rotor plate 46 for the passage therethrough of latch 39. The central opening 54 of the other rotor plate 45 is surrounded by circular ratchet 58, with the teeth 59 of the ratchet extending inwardly between rotor plates 45 and 46 for engagement with latch 39.

Latch plunger assembly 60 comprises outer cylindrical spool 61 having spiral threads 62 formed on the outer surface of its inner end, and collar 64 formed at its other end, with lever protrusions 65 extending radially outwardly from opposite sides of collar 64. Plunger 66 is telescopically received within the longitudinal bore of outer cylindrical spool 61, and coil compression spring 68 biases the plunger 66 to its retracted position by engagement between collar 64 and the end cap 70 of the plunger. The threads 62 are received in the internal threads 63 at the distal end of spring axle 29, which holds the spring axle 29, rotor 44, washer 35, cap 36 and latch 39 together, with the rotor 44, spring axle 29 and plunger assembly being rotatable with respect to the drum 11.

When the end cap 70 is pressed against the bias of spring 68, the plunger will protrude from outer cylindrical spool 61 and engage latch 39, pushing latch 39 against the bias of its coil compression spring 40, thus moving latch 39 out of engagement with the teeth 59 of ratchet 58. This effectively disconnects rotor 44 from coil torsion spring 21, allowing the spring and its axle 44 to freely rotate to an unbiased position while rotor 44 remains still. When cap 70 is released so that its coil compression spring moves the plunger back within the confines of its outer cylindrical spool 61, latch 39 moves under the bias of its spring 40 back into engagement with the teeth 59 of ratchet 58, thus locking the rotor 44, latch 39 and coil torsion spring 21 together, so that when the rotor is rotated about the spring axle 29, the spring axle will rotate in unison with the rotor and wind against the bias of coil torsion spring 21. This causes a rotational bias to be applied to rotor 44.

A rotary cleat 71 is mounted to the inside surface of door 15 and is rigidly connected to crank 20 that is mounted to the outside surface of the door. Rotary cleat 71 includes tines 72 with spaces formed therebetween, such that when the door 15 is moved to its closed position, the tines 72 will straddle the lever protrusion 65 of latch plunger assembly 60, so that when crank 20 is rotated, the rotary cleat will rotate latch plunger assembly 60. This causes latch 39 to rotate spring axle 29, thereby winding torsion spring 21. As latch 39 rotates in a clockwise direction, it slips over the sloped portions of the ratchet teeth 59 of rotor 44, so that rotor 44 is not required to rotate. When the spring has been rotated to the proper tension as desired by the operator, the spring will bias rotor 44 in the opposite, counterclockwise direction (FIGS. 5–8).

As illustrated in FIGS. 5–8, the dividers 52 of rotor 44 diverge in width from their inner portions to their outer radial portions, and the spaces 74 between the dividers 52 are formed by parallel side edges 75 of the dividers which form approximately rectangular spaces between the dividers. Further, the outer edge portion of most of the dividers include semi-circular recess 76.

As illustrated in FIG. 3, drum 11 includes a spiral track or divider 78 that is mounted to front wall 14, with the spiral track 78 extending from a position adjacent inner cylindrical housing 24 progressively slightly more than three revolutions within drum 11, and terminating at its connection 79 to the cylindrical outer wall 12 at a position just beyond the outlet opening 80 of the drum. With this arrangement, spiral track 78 forms a spiral path 81 internally of drum 11, into which rounds of ammunition can be loaded and which are followed by the rounds of ammunition as the rounds are moved within the drum 11 by rotor 44.

As illustrated in FIGS. 5–8, rotor 44 is placed in overlying relationship with respect to spiral track 78. Rounds of ammunition 82 are placed in drum 11 by inserting the rounds in the spaces 74 between the dividers 52 of the rotor 44, with each round of ammunition also protruding inwardly beyond the rotor 44 into the spiral path 81 formed by the spiral track 78. Also, additional rounds of ammunition 84 are inserted in the semicircular recesses 76 at the outer peripheral portion of most of the dividers 52, with these rounds of ammunition also extending into the spiral path 81. It will be noted that the larger recesses 74 between the dividers are deep enough so as to span three concentric portions of the spiral path 81 of the drum, whereas the outer recesses 76 register with only the outermost portion of the spiral path 81.

As shown in FIGS. 2, 4 and 5–8, the last round follower 85 is connected to a peripheral portion of rotor 44. Last round follower 85 is formed in three links, inner 86, intermediate link 88 and outer link 89. Inner link 86 is connected at one of its ends by a pivot pin 90 to a pair of dividers 52A and 52B of rotor 44, by the insertion of pivot pin 90 through the aligned openings 91A and 91B of the dividers 52A and 52B and through the hinge element 92 of link 86. The other end of link 86 and an adjacent end of link 88 also include complimentary hinge elements 94 and 95 for receiving pivot pin 96. Likewise, the other end of intermediate link 88 and an adjacent end of outer link 89 include complimentary hinge elements 98 and 99 for receipt of pivot pin 100. Thus, the links 86, 88 and 89 are freely pivotable about pivot pin 90 and the outer portion of rotor 44. It will be noted that the distal end portion 101 of outer link 89 is formed with oppositely extending lateral protrusions 102 and 103, with slots 104 and 105 formed between the protrusions 102 and 103 and the intermediate body portion of link 89.

The links 86, 88 and 89 of last round follower 85 are of a width smaller than the space between rotor plates 45 and 46 of rotor 44, except for protrusions 102 and 103, and the slots 104 and 105 are spaced apart a distance that corresponds to the spacing of rotor plates 45 and 46. Thus, the three links 86, 88 and 89 will freely move between rotor plates 45 and 46 and the slots 104 and 105 will engage the rotor plates, with the protrusions 102 and 103 extending laterally beyond the outer side surfaces of their rotor plates 45 and 46.

Figure 5:
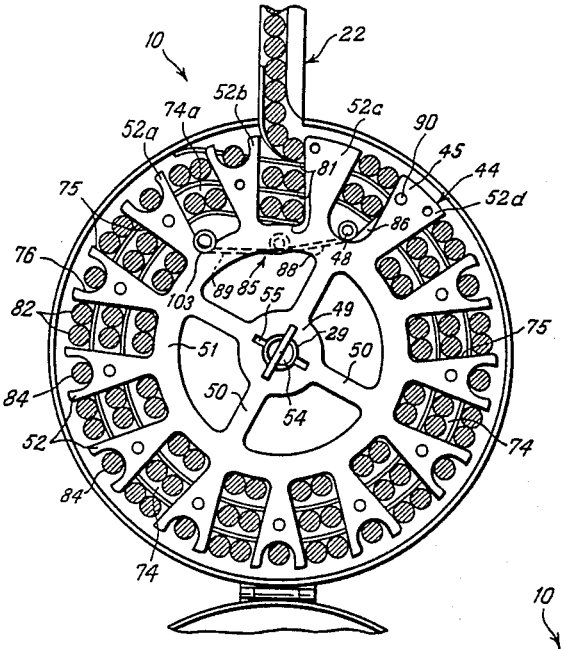
FIGS. 5, 6, 7 and 8 are rear views of the spiral drum magazine, with FIG. 5 showing the magazine fully loaded, and with FIGS. 6, 7 and 8 showing progressive conditions of the magazine as the rounds of ammunition are fed therefrom.

As illustrated in FIG. 5, it will be noted that the last round follower 85 extends radially inwardly of the rotor 44 from its pivot pin 90, with the protruding end portions 103, 104 resting at the innermost edge of the space 74A between dividers 52A and 52B. The lengths 86, 88 and 89 extend radially inwardly so as to avoid contact with the rounds 82 of ammunition positioned between the dividers 52C and 52D. The protrusions 103 projects laterally inwardly into the innermost portion of spiral path 81. Intermediate link 88, when pivoted inwardly of the rotor 44, engages the connecting pin 48 which prevents this portion of the last round follower from moving too far radially inwardly of the rotor 44.

Figure 9:
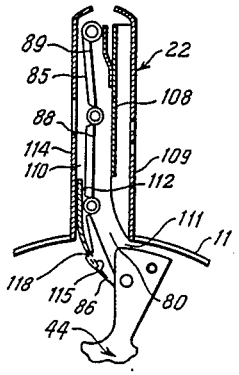
FIG. 9 is a cross-sectional view of the rectilinear clip magazine, showing the last round follower extended from the rotor of the drum magazine into the clip magazine.

As illustrated in FIGS. 1 and 9, the elongated magazine clip 22 is of conventional outside shape, being of conventional width and depth and of the desired length. This permits the assembly to be mounted to a convention weapon. However, the inner portion of the magazine clip 22 is formed so as to accommodate the rounds of ammunition in a single row, instead of in the conventional staggered row arrangement. Partition 108 is mounted to a side wall 109 of magazine clip 22 so as to make the passage 110 through the magazine clip 22 narrower. Also, the lower opening 111 of clip 22 is mounted to drum 11 so that it registers with the outlet opening 80 of the drum, and a guide 112 is mounted to the opposite side wall 114 and includes a pair of downwardly protruding finger elements 115 (FIG. 4) which protrude into drum 11 and into the outer portion of spiral path 81, with the space between fingers 115 being slightly larger than the thickness of rotor 44, so that the fingers 115 straddle the rotor. With this arrangement, the rotor 44 passes between fingers 115, and the fingers 115 pick the rounds of ammunition out of the rotor as the rotor passes adjacent the clip 22.

Figure 6:
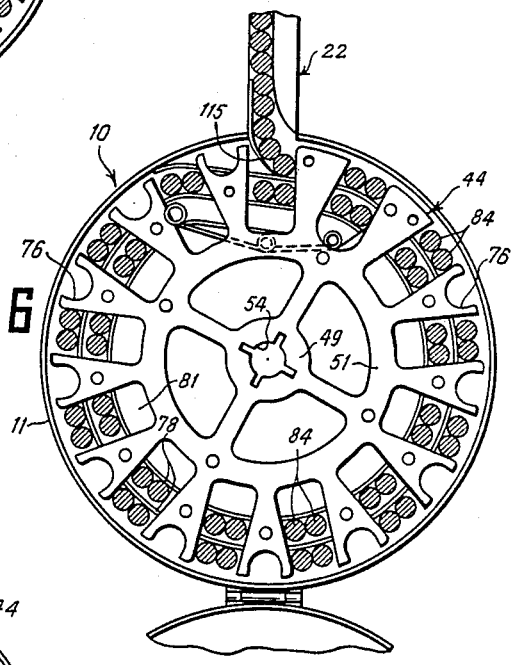

As illustrated in FIG. 6, rotor 44 has been rotated one complete revolution after having been filled with ammunition. The inner circular supply of ammunition will have been moved by the rotor in a counterclockwise direction, and the spiral divider 78 will have caused those rounds of ammunition to have moved into the intermediate portion of the spiral path of the drum. In the meantime, the intermediate and outer layers of ammunition will have also progressed, with the outer line of ammunition having been picked from the drum by the fingers protruding inwardly of the drum from the clip magazine 22, so that the outer ammunition will have passed upwardly through the clip 22. In the meantime, the last round follower will have progressed along with the other rounds of ammunition from its innermost position into the intermediate circular portion of the spiral path.

It should be noted that during the first revolution of the rotor 44 all of the rounds of ammunition will have been picked from the outer semicircular recesses 76 of the dividers 52, and these recesses will remain empty during the remaining revolutions of the rotor 44.

Figure 7:
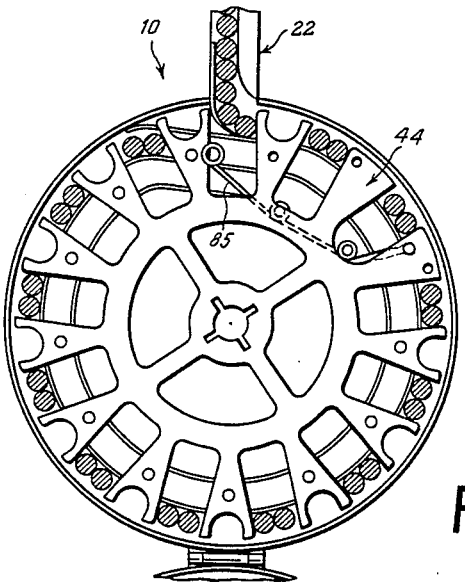

FIG. 7 illustrates the rotor 44 after it has been rotated through two complete revolutions. It will be noted that the innermost and intermediate layers of ammunition will have progressed through the spiral drum magazine and its clip magazine, and only the outer portion of the spiral path still has ammunition remaining therein. Also, the last round follower 85 is about to move from the intermediate portion of the spiral path to the outer portion thereof.

Figure 8:
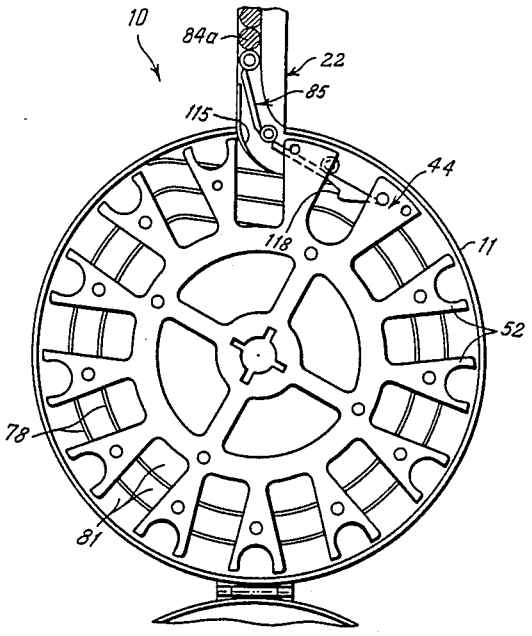

As illustrated in FIG. 8, after three complete revolutions of the rotor 44, the last round follower 85 finally makes contact with the last round of ammunition, with its protruding end portion pushing against the last round 84A. The fingers 115 pick the protruding portion of the last round follower out of its slot between the dividers of the rotor and cause the protruding portion to progress upwardly through the magazine clip 22.

As illustrated in FIG. 9, the inner link 86 of the last round follower has a notch 118 formed thereon, and when the last round follower 85 has been fully distended into the clip magazine 22, the notch 118 engages guide 112, thereby terminating any further movement of the last round follower 85 upwardly through the clip magazine 22, so that the last round follower will not protrude too far into the clip magazine. Further, engagement between the inner link 86 and the guide 112 tends to terminate the rotary movement of rotor 44. In the event that notch 118 should not properly register with guide 112, inner link 86 simply wedges in the clip magazine 22 and therefore prevents further rotary movement of rotor 44.

While this invention has been described in detail with particular reference to a preferred embodiment thereof, it will be understood that variations and modifications can be effected within the spirit and scope of the invention as described hereinbefore and defined in the appended claims.

I claim:

1. A spiral drum magazine comprising a drum with an exterior approximately cylindrical wall, a front wall and a rear wall, said cylindrical wall defining a radial opening sized and shaped to pass a round of ammunition, an elongated open ended clip magazine mounted to said drum and extending radially thereform at said radial opening of said cylindrical wall for passing rounds of ammunition therethrough, an approximately spiral-shaped divider rigidly positioned in said drum and extending from a central portion of said drum progressively outwardly to said opening for guiding rounds of ammunition in series long a spiral path to said radial opening, a rotor positioned in said drum adjacent said spiral divider and rotatable amount the longitudinal axis of said cylindrical wall, said rotor comprising a pair of rotor plates and means for maintaining said plates in spaced, parallel relationship, said rotor plates defining a plurality of circumferentially spaced radially outwardly facing slots for moving rounds of ammunition in series along the spiral path formed by said spiral shaped divider, spring means for rotating said rotor, and a last round follower for pushing the last round of ammunition from the spiral path of said spiral divider, said last round follower being positioned between said rotor plates and having a width less than the space between the rotor plates so as to be movable between said plates, and being pivotably connected at one end to said rotor with the other end including a protrusion having a width greater than the space between the rotor plates and extending beyond the plates and into said spiral path whereby the protrusion of said last round follower moves along the spiral path as the rotor rotates, through the radial opening and through the clip magazine.

2. The spiral drum magazine of claim 1 and wherein said last round follower is sized and shaped so that said protrusion is movable through the radial opening of the cylindrical wall of said drum and into said clip magazine so as to push the last round of ammunition through the clip magazine toward the weapon to which the clip is attached.

3. A spiral drum magazine comprising a drum with an exterior approximately cylindrical wall, a front wall and a rear wall, said cylindrical wall defining a radial opening sized and shaped to pass a round of ammunition, an elongated open ended clip magazine mounted to said drum and extending radially therefrom at said radial opening of said cylindrical wall for passing rounds of ammunition therethrough, an approximately spiral-shaped divider rigidly positioned in said drum and extending from a central portion of said drum progressively outwardly to said opening for guiding rounds of ammunition in series along a spiral path to said radial opening, a rotor positioned in said drum adjacent said spiral divider and rotatable about the longitudinal axis of said cylindrical wall, said rotor defining a plurality of circumferentially spaced radially outwardly facing slots for moving rounds of ammunition in series along the spiral path formed by said spiral shaped divider, spring means for rotating said rotor, and a last round follower for pushing the last round of ammunition from the spiral path of said sprial divider, said last round follower comprising a first link pivotably connected at one of its ends to said rotor, an intermediate link pivotably connected at one of its ends to the distal end of said first link, and an outer link pivotably connected at one of its ends to the other end of said intermediate link, a protrusion formed at the distal end of said outer link, said protrusion being sized and shaped to protrude into the spiral paths formed by said spiral shaped divider, whereby the protrusion of said last round follower moves along the spirial path as the rotor rotates, through the radial opening and through the clip magazine; and wherein said rotor comprises a pair of rotor plates maintained in spaced parallel relationship by a plurality of connector pins, and wherein said first and intermediate links of said last round follower are of a width less than the space between said rotor plates and are positioned between said rotor plates, and wherein said protrusion is of a width greater than the space between said rotor plates and extends beyond the rotor plates into the spiral path.

4. The drum magazine of claim 3 and wherein said spring means comprises a spring crank rotatably mounted to said drum and arranged to wind said spring, and spring release means for relieving the bias of said spring, said spring release means including a latch assembly having a pair of radially extending wings operatively connected to said spring and a ratchet attached to said rotor, said latch assembly being adapted to selectively engage said ratchet.

5. The drum magazine of claim 3 and further including an axle mounted to said front wall and positioned concentrically in said cylindrical wall, said spring means comprising a coil torsion spring having one portion connected to and rotatable with said axle and another portion connected in stationary relationship with respect to said drum, a latch member including a pair of radially extending wings releasibly connecting said rotor to said axle, a crank for rotatating said axle with respect to said rotor so as to apply spring bias to said rotor, and a latch actuator for disconnecting said rotor and said axle to relieve the spring bias to said rotor.

6. The drum magazine of claim 3 and wherein the plurality of circumferentially spaced radially outwardly facing slots of said rotor are formed by adjacent ones of a series of radially extending dividers, and wherein at least some of said dividers each include a radially outwardly facing notch for receiving a round of ammunition.

7. A magazine for feeding rounds of ammunition to an automatic weapon comprising a drum magazine including a drum, a drum outlet opening formed in said drum for passing rounds of ammunition from said drum, a clip magazine mounted to said drum about said outlet opening for passing rounds of ammunition radially from said drum to the weapon, a rotor for moving rounds of ammunition in a circular path toward said drum outlet opening, and a last round follower carried by said rotor for engaging and urging the last round of ammunition from said drum in a radial direction from said drum along the length of said clip magazine, said rotor comprising a pair of rotor plates and means for maintaining said plates in spaced parallel relationship with said plates defining a plurality of circumferentially spaced radially outwardly facing slots for receiving rounds of ammunition, and said last round follower being formed in at least two links pivotably connected together at their ends and being positioned between said rotor plates and having a width less than the space between the rotor plates so as to be movable between said plates and being pivotably connected at one end to inwardly opposing sides of said plates with the other end of said last round follower including a protrusion extending beyond said plates through an opposing set of said radially outwardly facing slots whereby a first one of the links can be pushed by the second one of said links through a turn from the drum into the clip magazine, and after the first link has moved into the clip magazine the second link is pushed by the rotor through the turn from the drum into the clip magazine.

8. The magazine of claim 7 and wherein said drum magazine defines a spiral path, and said rotor accommodates more than one circular arrangement of rounds of ammunition positioned in the spiral path.

9. In a drum magazine for feeding rounds of ammunition to an automatic weapon comprising a drum with a cylindrical wall, a front wall and a rear wall, a rotor concentrically mounted in said drum, spring means for rotating said rotor, an outlet in said cylindrical wall, and connector means for connecting said drum at said outlet to the breech of a weapon, the improvement therein of said rear wall comprising a door, hinge means connecting said door to said cylindrical wall at a position remote from said connector means so that said door opens away from said connector means, and latch means for holding said door in closed relationship with respect to said cylindrical wall, an axis mounted concentrically in said drum with said spring means comprising a torsion spring connected at one of its ends to and rotatable with said axle and mounted at the other of its ends in stationary relationship with respect to said drum, a latch assembly releasibly connected between said rotor and said axle, a crank member mounted to said door, said crank member including a latch engaging member movable with said door into engagement with said latch assembly and arranged to rotate said latch assembly whereby the spring means can be wound by said crank member when the door is closed.

10. The magazine of claim 9 and wherein said rotor includes a ratchet, and wherein said axle defines a slot extending along its length, and said latch assembly includes a latch element positioned in said slot and spring means urging said latch element into engagement with said ratchet to permit rotation of said axle in one direction with respect to said rotor and to lock said axle against rotation with respect to said rotor in the other direction of rotation, and a plunger for moving said latch element out of engagement with said ratchet to permit the torsion spring means to freely rotate said axle with respect to said rotor.

11. In a drum magazine for feeding rounds of ammunition to an automatic weapon including a drum, an opening in said drum for passing rounds of ammunition radially therefrom to a weapon, an axle mounted concentrically in said drum, a door hingedly connected to said drum, a rotor concentrically and rotatably mounted with said drum, and spring means for rotating said drum, the improvement therein of said rotor comprising a pair of similar rotor plates, connected pins for maintaining said rotor plates in parallel, concentric, spaced and circumferentially aligned relationship, each said rotor plate including a series of radially extending dividers with adjacent ones of said dividers forming spaces therebetween for holding a plurality of rounds of ammunition, and at least some of said dividers defining at their outer surfaces outwardly facing recesses sized and shaped and spaced from said drum a distance sufficient to receive at least a single round of aummunition, and wherein said spring means comprises a torsion spring connected at one of its ends to and rotatable with said axle and mounted at the other of its ends in stationary relationship with respect to said drum, a latch assembly releasibly connected between said rotor and said axle, a crank member mounted to said door, said crank member including a latch engaging member movable with said door into engagement with said latch assembly and arranged to rotate said latch assembly whereby the spring means can be wound by said crank member when the door is closed.

12. The drum magazine of claim 11 and wherein said drum includes a spiral track for storing rounds of ammunition in a spiral path within said drum and wherein the spaces formed between adjacent ones of said radially extending dividers each extend radially inwardly within said drum a distance sufficient to register with at least two concentric segments of the spiral path, whereby rounds of ammunition are placed in the concentric segments of the spiral path and in the spaces between adjacent ones of the divider of said rotor.

13. The drum magazine of claim 11 and further including a clip magazine mounted to said drum at the opening in said drum and extending generally radially from said drum for attachment to a weapon, and wherein said rotor includes a last round follower formed in at least two links, with a first link pivotably connected at one of its ends to said rotor and said links connected in end-to-end relationship to each other and the last link including a protrusion thereon for engaging the last round of ammunition, said links being sized nd shaped so as to turn from circumferential movement in said drum to radial movement through said clip magazine to urge the last round of ammunition through said clip magazine.

14. A magazine for storing rounds of ammunition and progressively feeding the rounds of ammunition in series to an automatic weapon comprising:

a drum magazine defining a circular path therein for the storage and movement of the rounds of ammunition, an outlet opening formed in said drum, a rotor comprising a pair of rotor plates and means for maintaining said plates in spaced parallel relationship, said rotor being rotatably mounted in said drum and defining radially outwardly facing recesses overlying said circular path for receiving therein rounds of aummunition and for moving the rounds of ammunition in series along said circular path to said outlet opening, a clip magazine mounted to said drum at said outlet opening and extending radially from said drum for connection to a weapon, and a last round follower connected to said rotor for urging the last round of ammunition from said drum magazine through said clip magazine, said last round follower being positioned between said rotor plates and having a width less than the space between the rotor plates so as to be movable between said plates and being pivotably connected at one end to said rotor with the other end including a protrusion having a width greater than the space between the rotor plates and extending beyond the plates, through one of said outwardly facing recesses and into said circular path.

15. The magazine of claim 14 wherein said last round follower comprises at least two links, with a first link pivotably connected at one of its ends to said rotor, and said links being connected in end-to-end relationship and sized and shaped to turn from the circular path of said drum to a radial direction through said clip magazine.

16. The magazine of claim 14 and wherein said drum magazine comprises a cylindrical wall, a front wall and a back wall, a hinge connecting said back wall to said cylindrical wall at a position remote from said clip magazine so that the back wall functions as a door which can be opened away from said clip magazine.

17. The magazine of claim 14 wherein the circular path of said drum is formed by a spiral track which forms a spiral path of at least two revolutions in said drum magazine, and wherein said rotor overlies said spiral track, and wherein the radially outwardly facing recesses of said rotor extend inwardly of said rotor a distance sufficient to span at least two revolutions of the spiral path, whereby rounds and ammunition are loaded into overlying portions of the rotor recesses and the spiral path and as the rotor rotates the rounds of ammunition are progressively moved from the spiral path through the clip magazine.

18. The magazine of claim 16 and further including an axle rotatably and concentrically mounted in said drum magazine, a coil torsion spring surrounding said axle and having one end portion connected to and rotatable with said axle and its other end portion mounted in stationary relationship with respect to said drum, a latch assembly releasibly connected between said rotor and said axle, a crank member mounted to said door, said crank member including a latch engaging member movable with said door into engagement with said latch assembly and arranged to rotate said latch assembly whereby the torsion spring can be wound by said crank member when the door is closed.

19. A spiral drum magazine comprising:

a drum having an exterior approximately cylindrical side wall defining a radial opening sized and shaped to pass a round of ammunition, a front wall, and a rear wall, said rear wall being hingedly attached to said side wall at a position remote from said radial opening so as to function as a door;

an elongated open ended clip magazine mounted to said drum and extending radially therefrom at said radial opening of said cylindrical wall for passing rounds of ammunition therethrough;

an approximately spiral-shaped divider rigidly positioned in said drum and extending from a central portion of said drum progressively outwardly to said opening and defining a spiral path for guiding rounds of ammunition in series to said radial opening;

a rotor positioned in said drum adjacent said spiral divider and rotatable about the longitudinal axis of said cylindrical wall, said rotor comprising a pair of rotor plates and means for maintaining said rotor plates in spaced parallel relationship, said rotor plates defining a plurality of circumferentially spaced radially outward facing slots for moving rounds of ammunition in series along the spiral path formed by said spiral-shaped divider;

an axle rotatably and concentrically mounted in said drum;

a coil torsion spring surrounding said axle and having one end portion connected to and rotatable with said axle and its other end portion mounted in stationary relationship with respect to said drum;

a latch assembly releasibly connected between said rotor and said axle;

a crank member mounted to said door for winding the torsion spring when the door is closed, said crank member including a latch engaging member movable with said door into engagement with said latch assembly and arranged to rotate said latch assembly;

a last round follower for pushing the last round of ammunition from said spiral path and through said elongated clip magazine, said last round follower being of a width less than the space between said rotor plates so as to be movable between said plates and being pivotably connected at one of its ends to said rotor, and its distal end including a protrusion of a width greater than the space between said rotor plates and extending through one of said outwardly facing slots and into said spiral path.

* * * * *